US005305901A

United States Patent [19]

Dennig

[11] Patent Number: 5,305,901

[45] Date of Patent: Apr. 26, 1994

[54] LARGE-SCALE CONTAINER, PREFERABLY TRANSPORTABLE AND CLOSABLE BY A FIREPROOF SLIDING DOOR

[75] Inventor: Helmut Dennig, Bad Oeynhausen, Fed. Rep. of Germany

[73] Assignee: P & D Systemtechnik GmbH, Bad Oeynhausen, Fed. Rep. of Germany

[21] Appl. No.: 923,983

[22] PCT Filed: Feb. 12, 1992

[86] PCT No.: PCT/DE92/00109

§ 371 Date: Sep. 10, 1992

§ 102(e) Date: Sep. 10, 1992

[87] PCT Pub. No.: WO92/14901

PCT Pub. Date: Sep. 3, 1992

[30] Foreign Application Priority Data

Feb. 15, 1991 [DE] Fed. Rep. of Germany ..... 4104704

[51] Int. Cl.[5] ..... E06B 5/16

[52] U.S. Cl. ..... 220/1.5; 220/88.1; 428/192; 428/921; 160/43

[58] Field of Search ..... 160/43, 40; 49/477, 49/485, 406, 458, 467; 220/1.5, 88.1, 245, 248, 250, 215; 428/192, 920, 921

[56] References Cited

U.S. PATENT DOCUMENTS

| | | | |
|---|---|---|---|
| 2,638,190 | 5/1953 | Watkins | 49/458 |
| 3,111,981 | 11/1963 | Simbulan | 160/40 |
| 3,566,541 | 3/1971 | Coulter | 49/467 |
| 3,685,567 | 8/1972 | Pemberton et al. | 49/7 |
| 3,972,167 | 8/1976 | Vogeli | 52/481 |
| 4,203,255 | 5/1980 | Naslund et al. | 428/921 |
| 4,248,342 | 2/1981 | King et al. | 220/88.1 |
| 5,020,292 | 6/1991 | Strom et al. | 428/921 |
| 5,135,788 | 8/1992 | Nolte | 428/920 |

FOREIGN PATENT DOCUMENTS

| | | |
|---|---|---|
| 2613998 | 10/1977 | Fed. Rep. of Germany . |
| 3212640 | 10/1983 | Fed. Rep. of Germany . |
| 2485074 | 12/1981 | France . |
| 8301327 | 11/1984 | Netherlands . |
| 913396 | 12/1962 | United Kingdom . |

*Primary Examiner*—Allan N. Shoap
*Assistant Examiner*—S. Castellano
*Attorney, Agent, or Firm*—Feiereisen & Kueffner

[57] ABSTRACT

A large-scale container, preferably transportable and closable by a fireproof sliding door composed of several leaves, includes a fireproof bulkhead which is mounted parallel to the leaves along the ceiling of the large-scale container. The bulkhead extends over the entire width of the sliding door and projects in a gap defined by the spaced arrangement of the leaves, with the bulkhead and the leaves being provided along their facing sides in the overlapping areas with a fireproof intumescent coating. In this manner, a direct penetration of flames in this area into the interior is prevented and the space defined between the leaves and the bulkhead is closed by a fireproof intumescent coating to attain a hermetic seal.

6 Claims, 3 Drawing Sheets

LARGE-SCALE CONTAINER, PREFERABLY TRANSPORTABLE AND CLOSABLE BY A FIREPROOF SLIDING DOOR

The present invention refers to a large-scale container which is preferably transportable and closable by a fireproof sliding door in accordance with the preamble of claim 1.

Large-scale containers of this type which store inflammable materials and have an entrance opening closable by a sliding door encounter sealing problems in the area of the ceiling-side guidance of the leaves in case of fire, that is when there is a danger of fire penetrating from outside into the large-scale container, so that heat penetrating into the interior of the large-scale container may ignite the easily inflammable materials stored therein.

The present invention is based upon the object to create a large-scale container of this type in such a manner that the sliding door is optimally sealed in a fireproof manner with respect to the large-scale container.

This object is attained in accordance with the present invention by the features set forth in the characterizing part of claim 1.

These constructive measures effectively avoid in the upper area of the guidance a penetration of heat from outside into the interior of the large-scale container, with the insulant-forming layers, which are known per se, expanding upon contact by heat in order to seal an otherwise existing passage between the leaves, on the one hand, and the fireproof bulkhead, on the other hand.

In any event, the time required by hot air to pass the mentioned passage is longer than the reaction time of the insulant-forming layers.

In accordance with an advantageous embodiment of the invention, the leaves are each provided in the overlapping area in closing position thereof with overlapping elbow-shaped brackets which are provided with insulant-forming layers as well.

In this manner, a labyrinth-type passageway is created which is closed by the insulant-forming layers upon contact by heat so that a fireproof seal is obtained also in this area.

Moreover, the essentially form-fitting joint between both leaves substantially avoids a distortion thereof during heat impact so that the operativeness of the sliding door is maintained.

According to a further feature of the invention, a barrier is arranged also in the bottom area between and parallel to both leaves which acts like a fireproof bulkhead and is provided with insulant-forming layers along the sides thereof facing the leaves.

Also in this case, a fireproof seal is created which contributes to optimize the fire protection behavior of the sliding door.

Further advantageous features of the invention are set forth in the dependent claims.

Figure 1:
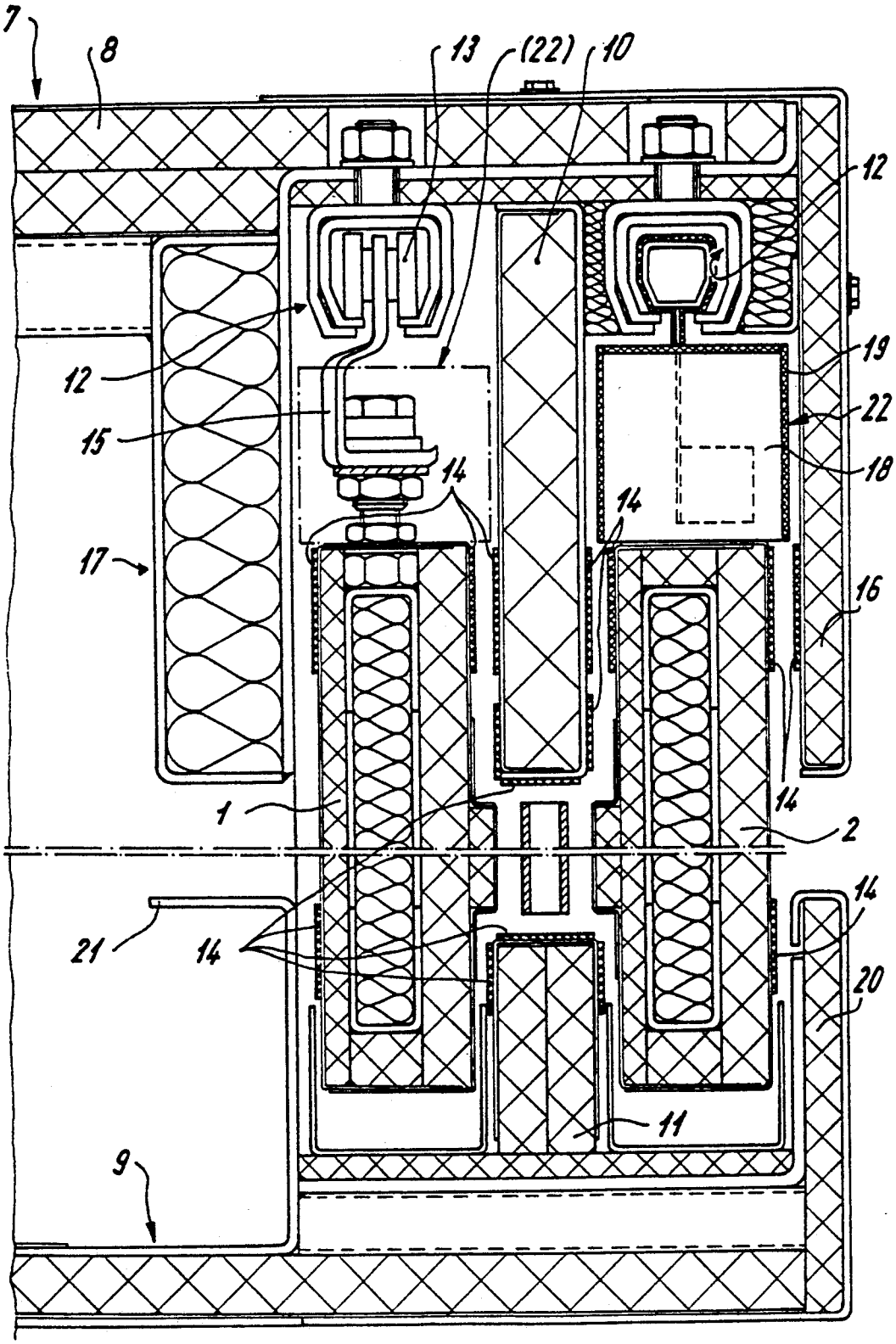
Figure 2:
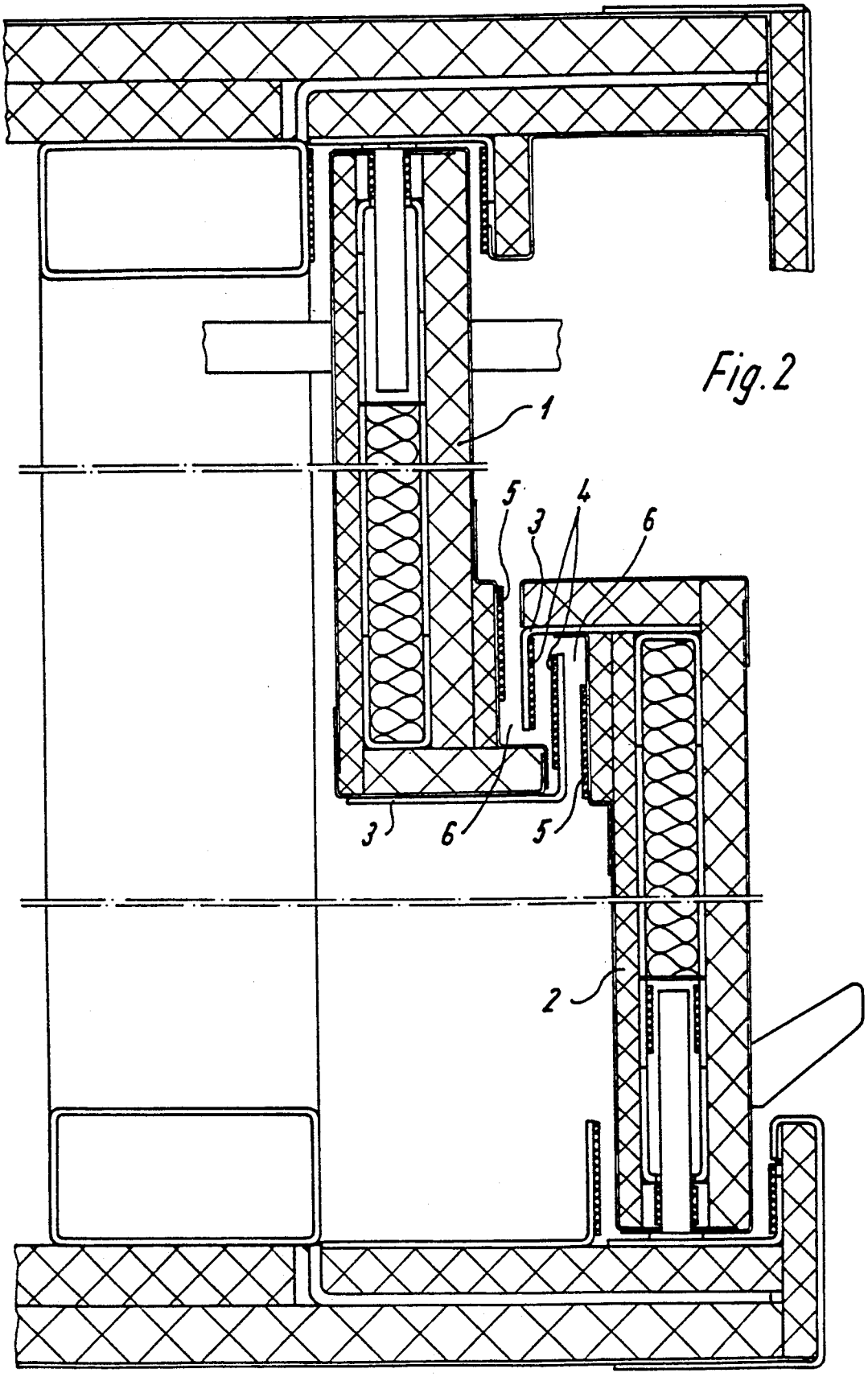
Figure 3:
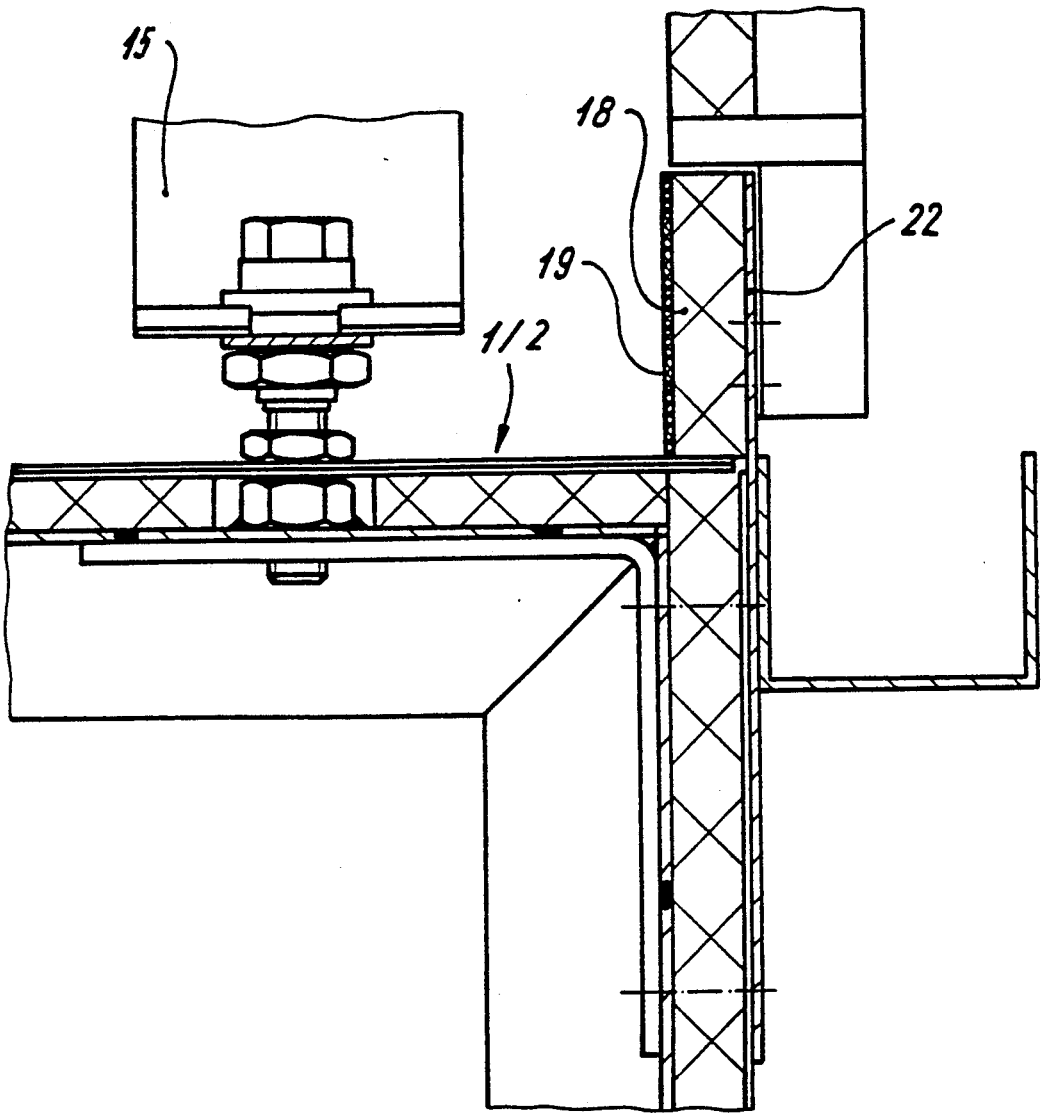

An exemplified embodiment of the invention will now be described with reference to the attached drawings in which FIG. 1 shows a partial longitudinal section through a large-scale container in the area of the sliding door, FIG. 2 shows a partial cross sectional view through the large-scale container also in the area of the sliding door, FIG. 3 shows a partial section of a leaf in the corner area for suspension from the ceiling.

FIG. 1 shows a large-scale container 7 having a ceiling 8 which is provided with two parallel guide rails 12 spaced from each other at a distance for slidably supporting two leaves 1, 2 of a sliding door by means of rollers 13.

The leaves 1, 2 are provided with cranked suspensions 15, with their free end face supporting the rollers 13 which run in the guide rails 12.

Further mounted to the ceiling 8 is a fireproof bulkhead 10 which is positioned between the spaced leaves 1, 2, extends over the entire width of the sliding door and projects into the space between the leaves 1, 2.

The sides of the leaves 1, 2 facing the bulkhead 10 as well as the sides of the bulkhead 10 facing the leaves 1, 2 are provided with a fireproof intumescent coating (insulant forming layers) 14 which has a volume expanding during fire i.e. at increase of the ambient temperature to thereby completely fill the existing space between the fireproof bulkhead 10 and the respective leaves 1, 2 so that a penetration of heat into the interior of the large-scale container is prevented.

Furthermore, in the area of the guide rails 12, the outside as well as the interior of the large-scale container 7 is provided with insulating boards 16, 17 which overlap the leaves 1, 2 in their upper area, with at least the sides of the leaves 1, 2 facing the insulating boards 16, 17 being also provided with insulant-forming layers 14.

Arranged in the area of the bottom 9 of the large-scale container 7 in alignment with the bulkhead 10 is a barrier 11 which extends over the width of the sliding door and projects into the lower space between the leaves 1, 2.

The barrier 11 is provided in the same manner as the bulkhead 10 with insulant-forming layers along its sides facing the leaves 1, 2.

Such insulant-forming layers are also provided in those areas of the leaves 1, 2 which are overlapped by sills 20, 21, with sill 20 being arranged at the outside of the large-scale container and sill 21 being arranged along the inside.

As clearly shown in FIG. 2, the leaves 1, 2 are provided in closing position along their facing longitudinal sides with elbow-shaped brackets 3 which extend over the entire height and overlap each other in closing position of the sliding door in the overlapping area.

The elbow-shaped brackets 3 are configured in such a manner that an angled leg extends parallel and at a distance to the pertaining leaf 1, 2, with this leg covering a part of the leaf 1, 2 and extending over its entire height.

The leg of the elbow-shaped bracket 3 of the respectively other leaf 1, 2 projects into the gap 6 which is defined by one leaf 1, 2 and the free leg of the pertaining elbow-shaped bracket 3 attached to that one leaf 1, 2.

Thus, the parallel legs of the respective elbow-shaped brackets 3 extend at a distance to each other as well as at a distance to the respectively other leaf 1, 2.

In this manner, a labyrinth-type passageway is created, with insulant-forming layers 4, 5 being glued to the elbow-shaped brackets 3 and the leaves 1, 2. As set forth above, heat generated during fire expands the volume of the insulant-forming layer so that the gap 6 is sealed against heat penetrating from the outside.

In the overlapping area of the closed leaves 1, 2, each end face thereof is provided with a sealing plate 18 which is provided with insulant-forming layers 19 for filling the remaining spaces between the sealing plates 18, on the one hand, and the fireproof bulkhead 10 and the insulating boards 16, 17, on the other hand, to absolutely guarantee that heat is prevented from penetrating also through this area into the interior of the large-scale container 7.

Arranged at the end face of each leaf 1, 2 facing the pertaining guide rail 12 is a box-shaped attachment 22 which is also jacketed with insulant-forming layers 19 to fill the adjacent spaces in a fireproof manner in case of need.

I claim:

1. A large-scale container, preferably transportable and closable by a fireproof sliding door, with the sliding door including several leaves, at least one of which being provided at its upper end with rollers guided in a guide rail arranged at a ceiling of the large-scale container, characterized in that a fireproof bulkhead (10) is mounted to the ceiling (8) of the large-scale container (7) parallel to the leaves (1, 2), with the bulkhead (10) extending over the entire width of the sliding door and projecting in a gap defined by a spaced arrangement of the leaves (1, 2), wherein the bulkhead (10) and the leaves (1, 2) overlap each other and are provided along their facing sides in an overlapping area with a fireproof intumescent coating (14).

2. The large-scale container according to claim 1, characterized in that a barrier (11) is arranged in an area of a bottom (9) in alignment to the fireproof bulkhead (10), with the barrier (11) extending over the entire width of the sliding door and projecting into a space between the leaves (1, 2) wherein at least those sides of the barrier (11) facing the leaves (1, 2) are provided with a fireproof intumescent coating (14).

3. The large-scale container according to claim 1, characterized in that an insulation board (16) is provided on the outside in an area of the guide rail (12) and extends at least over the entire width of the sliding door, with the insulation board (16) covering an upper area of an outside of a first leaf (2), wherein the facing sides of the first leaf (2) and the insulation board (16) are provided with a fireproof intumescent coating (14).

4. The large-scale container according to claim 1, characterized in that each outer leaf has an outer guide rail (12), and the outer guide rail (12) has near its top end face a box-shaped attachment (22) which is coated with a fireproof intumescent coating (19), with each of the top end faces being provided with a sealing plate (18).

5. The large-scale container according to claim 1, characterized in that in the overlapping area in closing position thereof, the leaves (1, 2) are provided with overlapping elbow-shaped brackets (3), with a fireproof intumescent coating (5) being attached thereto.

6. The large-scale container according to claim 5, characterized in that one elbow-shaped bracket (3) is mounted to a first leaf and includes a first leg which extends parallel at a distance to the first leaf (1, 2) and which partly overlaps the first leaf (1, 2) and extends over the entire height thereof, a second leaf including a second leg wherein in closing position of the sliding door the second leg of elbow-shaped bracket (3) of the second leaf projects in a gap defined by the first leaf (1, 2) and the first leg of the elbow-shaped one bracket (3) which is mounted to said first leaf.

* * * * *